United States Patent [19]

Forzano

[11] Patent Number: 5,018,331

[45] Date of Patent: May 28, 1991

[54] WALL REPAIR METHOD AND DEVICE

[75] Inventor: Richard Forzano, Cedar Grove, N.J.

[73] Assignee: RJF Industries, Inc., Cedar Grove, N.J.

[21] Appl. No.: 536,411

[22] Filed: Jun. 7, 1990

[51] Int. Cl.[5] ..... E04G 23/00

[52] U.S. Cl. ..... 52/514; 52/743

[58] Field of Search ..... 52/514

[56] References Cited

U.S. PATENT DOCUMENTS

| | | | |
|---|---|---|---|
| 1,669,541 | 5/1928 | Spreen | 52/514 |
| 2,997,416 | 8/1961 | Helton | 52/514 |
| 3,289,374 | 12/1966 | Metz | 52/514 |
| 3,373,467 | 3/1968 | Loughrey | 52/514 |
| 3,690,084 | 9/1972 | Leblanc | 52/514 |
| 3,717,970 | 2/1973 | Rosenblum | 52/514 |
| 3,874,505 | 4/1975 | Mirarchi et al. | 52/514 |
| 3,999,347 | 12/1976 | Devlin | 52/514 |
| 4,285,183 | 8/1981 | Condit | 52/514 |

*Primary Examiner*—Richard E. Chilcot, Jr.
*Assistant Examiner*—Joanne C. Downs
*Attorney, Agent, or Firm*—Lane, Aitken & McCann

[57] ABSTRACT

A device and method for the repair of holes in gypsum wallboard where the device is positioned behind the hole and temporarily secured. The device is the form of a hinged circular plate which can be folded in half to permit its insertion through the hole to be repaired. Elements connected to the two halves are provided to secure the plate in place for application of patching material by fixing the elements to the front surface of the wallboard.

10 Claims, 3 Drawing Sheets

WALL REPAIR METHOD AND DEVICE

BACKGROUND OF THE INVENTION

The present invention relates to a method and device designed to repair holes in hollow walls, doors and ceilings.

Gypsum wallboard is a common building material used in the construction of walls and ceilings. The wallboard typically consists of an inner gypsum material covered by paper forming a sandwich. The wallboard is secured to a plurality of spaced apart supporting members, which can be either studs, rafters or ceiling joists that form a hollow cored wall or ceiling. In walls that are contiguous with the exterior of a structure, the interstitial area is typically filled with an insulating material.

The repair of small holes in hollow walls and ceilings is accomplished by filling the space with a patching material. The consistency of the patching material is such that adhesion allows the material to bridge or span the opening. Larger holes such as those caused by the impact of a door knob or the relocation of an electrical outlet present a problem because the patching material will not fill the opening. Various methods and devices have been developed in an attempt to facilitate the repair of larger holes with limited success. Like the present invention, most attempt to secure a suitable material behind the opening in order to provide a support for the patching material to be deposited.

Problems presented by past methods and devices, include difficult installation procedures and a relatively high material cost. Further, many of these devices would leave an obstruction within the wall which may impede the placement of materials or equipment within the wall cavity.

SUMMARY OF THE INVENTION

Accordingly, the object of the invention is to provide an inexpensive device that is quickly and easily installed that is effective in the repair of holes in hollow cored walls and ceilings.

The invention includes a back plate or supporting plate member preferably formed of thin metal or stiff cardboard the dimensions of which are such that the plate member can bridge the particular hole which is to be repaired. Adhesive means or tangs are positioned around the periphery of the surface of the supporting plate member which engages the inner surface of the wall. The supporting plate member incorporates a hinge mechanism which allows the plate member to fold upon itself in half. Alternatively, the hinge mechanism could be designed to allow the back plate to be folded in quarters. The folded supporting plate member portion of the structure is inserted into the hole and then unfolded. When unfolded the structure occupies a larger area than that of the hole which is to be repaired and the structure is positioned against the inner surface of the wall which is to be repaired.

The device is pulled firmly against the interior edges of the opening by pulling attachments attached to and adjacent to the hinge mechanism and aligned with each other. The pulling attachments extend through the opening and are temporarily secured to the outer surface of the wall. Plaster or drywall joint compound is then deposited onto the backing surface provided by the unfolded supporting plate member. After the patching material has dried the pulling attachments are severed below the outer planar surface of the wall. The wall is then ready for a final application of patching material. At this time any holes formed by the securing of the pulling attachments are also repaired.

The invention contemplates a variety of different embodiments each of which incorporate pulling attachments that pass through the hole which is to be repaired and secured to the outer finished surface of the wall. The pulling attachment can be strings, plastic straps or light gauge metal bands, each of which can be anchored by different methods.

Although the invention is designed in particular to be employed in conjunction with gypsum wallboard, this invention could be applied to any sheet material that comprises a hollow core wall or ceiling, wherein access to the interior is not readily available.

DETAILED DESCRIPTION

Figure 1:
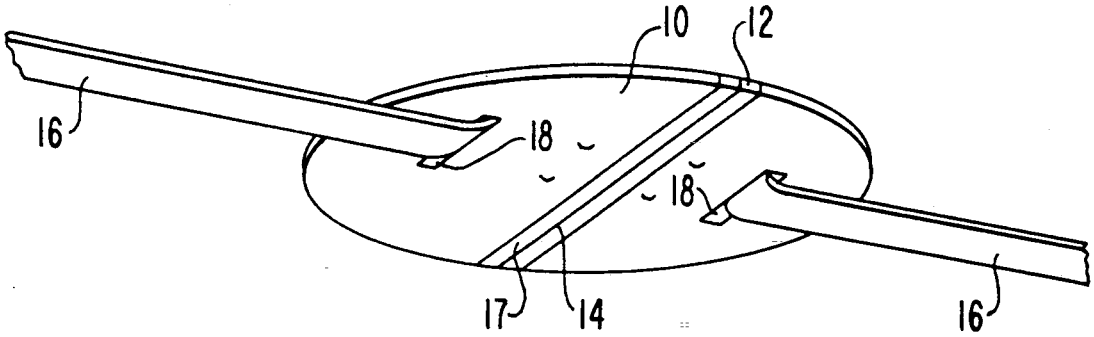
FIG. 1 is a perspective view of an improved wallboard repair patch according to the present invention.
Figure 2:
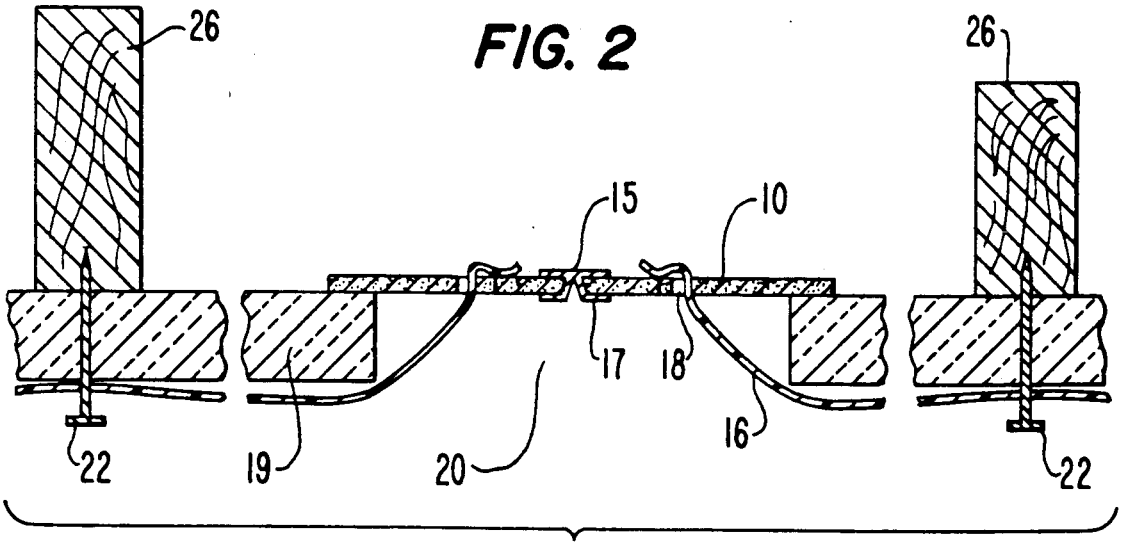
FIG. 2 is a cross section showing application of the device depicted in FIG. 1 in a hole in conventional gypsum wallboard.

As shown in FIG. 1 and FIG. 2, supporting plate member 10 comprised of stiff hard pressed cardboard and shaped as a circle is separated in half and joined by a hinge 12. Alternatively, the supporting plate may be rectangular or square. The hinge is constructed by scoring a line through the center of a circle made of hard pressed cardboard preferably ⅛" thick. While the cardboard is in a planar configuration masking tape 15 is affixed behind the score line 14 on the rear of the supporting plate member. The support plate member is folded in half along the score line 14 so as to form a semi-circle and masking tape 17 is affixed along the lateral edge surfaces formed by the score line 14. Portions of the tape 17 extending past the narrow lateral edge formed by the two adjacent chords of the semi-circle are folded over the edge to contact the planar semi-circular surfaces. When the structure is unfolded the tape on front side engages both the planar surfaces of the front of the supporting plate member and the two lateral edges of the cardboard which are revealed when the device is folded in half. Constructed as such, the device hinges on the rear surface and unfolding movement is restricted to a planar configuration by both the tape and the abutment of the lateral edges. Pulling attachments 16 originate from the rear surface of the supporting plate member and are affixed by staples to the rear surface of the supporting plate member. The pulling attachments are threaded through slots 18 located on the support plate member each side of the hinge. In the preferred embodiment the pulling attachments are comprised of plastic straps having high tensile strength.

FIG. 2 depicts the device as disclosed in FIG. 1. installed in a hollow cored wall. Supporting plate member 10 is positioned on the inner surface of a wall 19 so that it spans a hole 20 in the wall. The periphery of the supporting plate member engages the interior surface of the wall adjacent to the hole. The straps 16 pass through slots 18 in the supporting plate member and then through the hole in the wall. The straps are pulled and extended opposite each other and laterally along the outer surface of the wall where they are attached to the outer surface of the wall by nails 22. The straps are firmly secured by nails at a position on the outer surface of the wall so that the nails can engage studs 26 in the wall thereby providing a secure anchor. Preferably the pulling means are such a length that they reach the studs that support part of the wall. After nailing the straps 16 to the studs 26, the hole 20 is partially filled with patching material and the patching material is allowed to harden. After the patching material hardens, the straps 19 are severed below the surface of the wall. The nails 22 are removed and the final coat of dry wall patching material is applied in the conventional manner.

Figure 3:
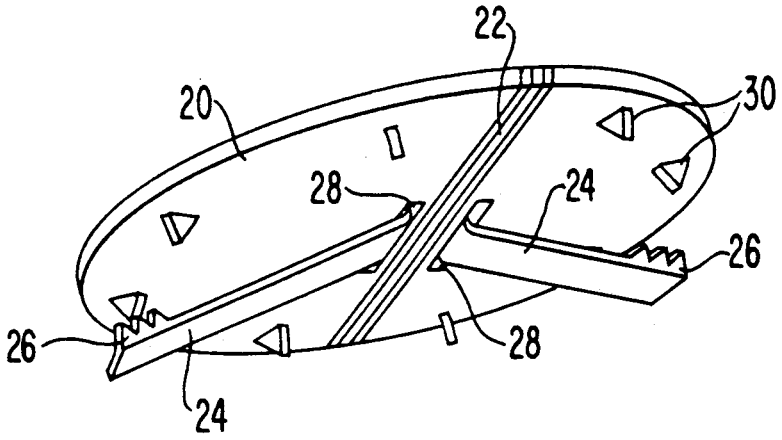
FIG. 3 is a perspective view of a second embodiment of the invention.

FIG. 3 is an alternative embodiment of the invention wherein the support plate member 20 is comprised of light gauge aluminum. Dividing the supporting plate member 20 is a hinge 22 also comprised of aluminum. The hinge 22 permits the plate member to be folded in half. The pulling means are comprised of rigid aluminum bands or arms 24 which incorporate a series of teeth 26 located on the distal ends. The teeth located on the ends of the arms can engage the outer surface of the edge of a hole which is to be repaired and facilitate the penetration of the gypsum wallboard. The proximal ends of the arms are attached to the supporting plate member by hinges 28 which permit free movement of the arms. The hinges 28 are located at a position near the center fold or hinge 22 of the supporting plate member. Also depicted are teeth 30 located on the periphery of the supporting plate member.

Figure 4:
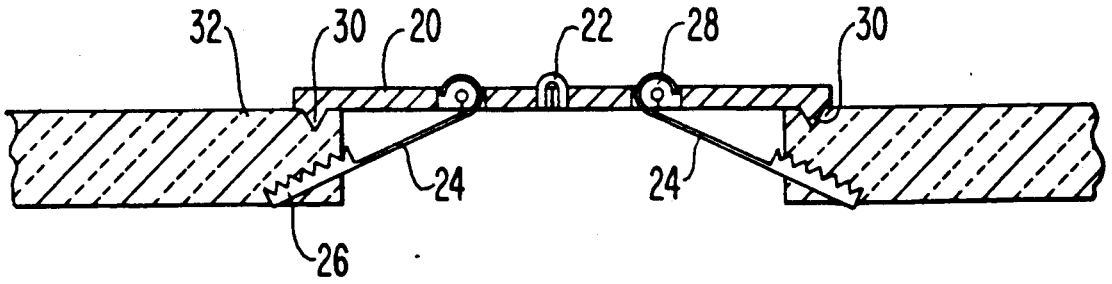
FIG. 4 is a cross section showing the application of the embodiment depicted in FIG. 3 in a hole in gypsum wallboard.

In FIG. 4, a cross section of the embodiment disclosed in FIG. 3 is shown after installation in a hole in a wall. The device is folded, inserted through the hole in the wall and then unfolded. The device is then pulled firmly against the interior surface of the wall by arms 24 which are shown extending from the support member 20. Pulling the arms engages the teeth 30 into the gypsum wallboard. The arms 24 are suct a length that they can engage the outer edge of the hole which is to be repaired. The distal ends of the arms are driven into the exterior surface of the drywall at the peripheral edge of the hole until each of both arms 24 are below the plane of the exterior surface of the wall. The distal ends of the arms which incorporate teeth 26 or serrata penetrate and secure the arms to the wallboard.

In this embodiment of the invention it is readily apparent that the hole which is to be repaired can be filled in one application of patching material without the necessity of returning after the patching material has dried to repair holes or other imperfections left in the surface. Another advantage in this embodiment is that there are no projections beyond the planar surface of the outer wall which permits the repairer to pass over the entire area with a large dry wall knife blade which helps to achieve a smooth surface on the patching material. Thus, a hole can be repaired in less time and with less work.

Figure 5:
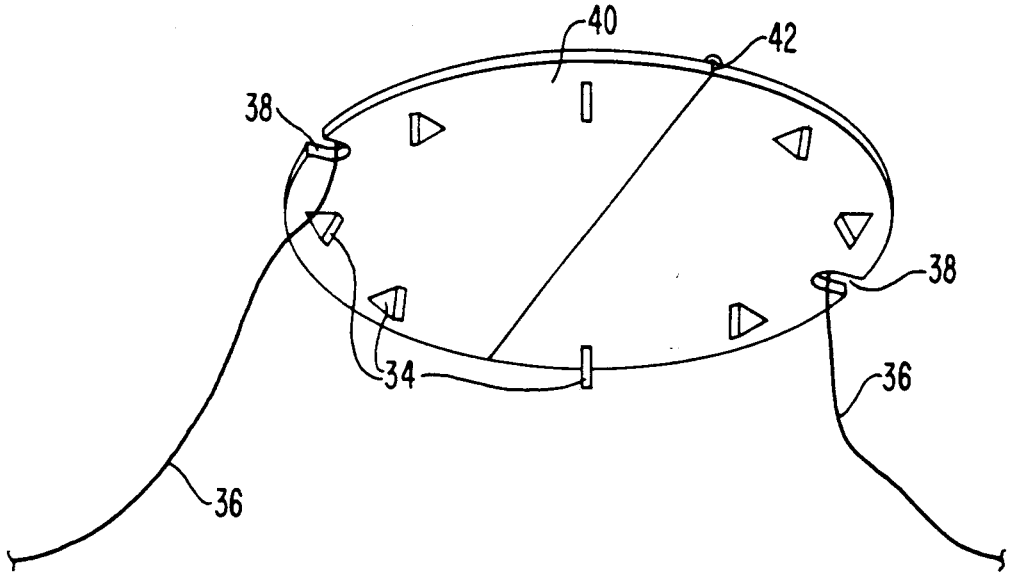
FIG. 5 is a perspective view of yet another embodiment of the invention which employs strings as pulling attachments.

FIG. 5 is yet another embodiment of the invention. Teeth 34 protrude from the periphery of the front of supporting plate member 40. In this embodiment the pulling means are comprised of soft aluminum wire 36. The wire passes through channels 38 cut through the supporting plate member 40 at the peripheral edge thereof. Like the other embodiments disclosed in FIG. 1 and FIG. 3 the support plate member incorporates a hinge 42 which allows the device to be folded in half. It is preferable to attach the wire at a point on the rear of the device near the center of the support plate member to ease manipulation of the device into position behind the hole which is to be repaired and prevent the device from falling into the interstitial space within the wall. It is evident that the wire could also pass through an opening in the support plate.

Figure 6:
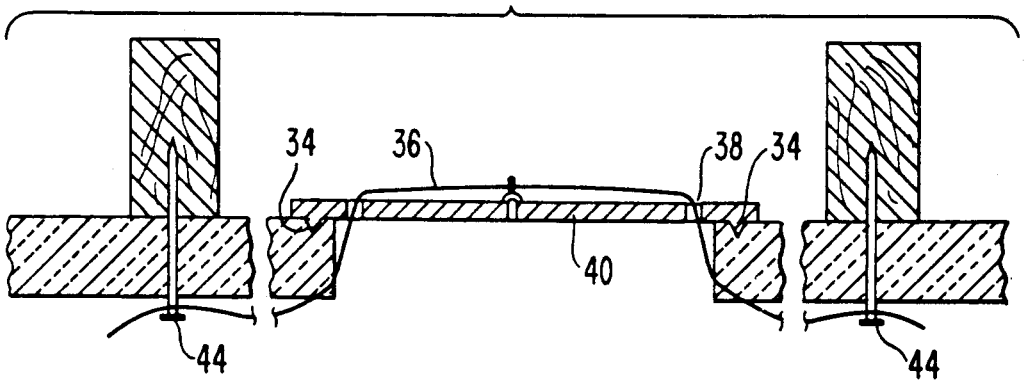
FIG. 6 is a cross section of a wall constructed of gypsum wallboard with a hole showing the application of the invention as depicted in FIG. 5.

FIG. 6 shows a cross section of the device depicted in FIG. 5 after it has been inserted into position and behind the hole which is to be repaired. The aluminum wire 36 is guided from behind the supporting plate member 40 through channels 38. The wire is passed through the hole which is to be repaired and pulled firmly to engage the teeth 34 in the rear surface of the gypsum wallboard. The ends of the wire are pulled in opposite directions parallel with the outer surface of the wall and are secured by nails or screws 44 that engage the studs 48 in the wall. In this embodiment the soft aluminum wire is hammered at the outer peripheral edge of the hole until it is forced into the gypsum wallboard material thus forming a thin groove that extends outside the circumference of the hole. The hole is then rough filled with the patching compound. After about 24 hours the compound is dry and will have firmly secured the backing in place. The soft wire is then cut below the outer planar surface of the wall and the hole is ready for a final application of patching compound.

Figure 7:
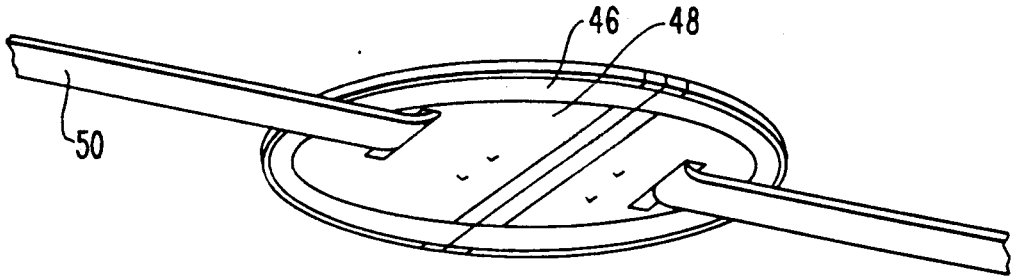
FIG. 7 shows an alternative embodiment of the invention whereby a pressure sensitive adhesive is employed on the periphery of the supporting plate member.

FIG. 7 shows an alternative embodiment of the invention whereby a pressure sensitive adhesive is employed on the periphery of the supporting plate member 48 that permits the backing device to engage the interior surface of the wall which is to be repaired. A non-stick protective covering (not shown) is removed from the adhesive 46 before the device is positioned behind the hole. Removable pulling attachments 50 are pulled to firmly secure the device to the interior surface of the wall. This embodiment is easily adapted to each of the preceding embodiments depicted. Adhesive is used in place of teeth on the supporting plate periphery as depicted in FIGS. 3, 4, 5 and 6. The pulling attachments can then be removed after the adhesive has set. The hole is then prepared to be filled with patching material.

The above description is of preferred embodiments of the invention and modification may be made thereto without departing from the spirit and scope of the invention, which is defined in the appended claims.

I claim:

1. A backing device for use in repairing hollow walls and ceilings, comprising:

a foldable support plate member, said plate member including at least two segments joined by hinging means; and pulling means for transmitting a pulling force to said foldable support plate member on opposite sides of said hinging means through a hole in a wall which is to be repaired whereby said support plate member can be folded and inserted through said hole in said wall, and unfolded inside said hole, and said pulling means pulled through said hole and secured to the exterior of said wall.

2. The backing device recited in claim 1 wherein said folding support plate member and hinge means comprise aluminum.

3. The backing device recited in claim 2 wherein said folding support plate member incorporates a series of teeth, said teeth located on the periphery of the front side of said supporting plate member whereby after said supporting plate member is inserted through a hole in a wall which is to be repaired, and unfolded, said teeth can engage said support plate member to the inner surface of said wall behind said hole.

4. The backing device recited in claim 1 wherein said folding support plate member comprises hard pressed cardboard and the hinge means comprises masking tape.

5. The device as recited in claim 1 wherein said pulling means comprises soft aluminum wire or string.

6. The device as recited in claim 1 wherein said pulling means comprises rigid flat arms attached to the foldable support plate member.

7. The device as recited in claim 3 wherein said pulling means comprises rigid flat arms attached to the foldable support plate member.

8. The device as recited in claim 7 wherein said arms incorporate adhesive means on the distal ends of said arms whereby said adhesive means can engage the outer peripheral edge of a hole which is to be repaired.

9. The device as recited in claim 8 wherein said adhesive means are a series of teeth or serrata.

10. A method for repairing a hollow cored wall or ceiling employing the backing device recited in claim 1 comprising folding said support plate member at said hinge means, inserting said support plate member through a hole in said wall or ceiling, unfolding said support plate member behind said wall, pulling on said pulling means so that the peripheral edges of said supporting plate member engage the interior surface of said wall, attaching said pulling means to the exterior of said wall and applying patching material to the support plate member filling said hole.

* * * * *